United States Patent [19]

Gribb

[11] Patent Number: 4,580,360

[45] Date of Patent: Apr. 8, 1986

[54] FOOD LABEL DEVICE, KIT OF COMPONENTS THEREFOR, AND METHODS OF CONSTRUCTING AND UTILIZING SAME

[76] Inventor: Robert J. Gribb, 14652 Berwick, Livonia, Mich. 48154

[21] Appl. No.: 629,586

[22] Filed: Jul. 11, 1984

[51] Int. Cl.[4] ..... G09F 3/10

[52] U.S. Cl. ..... 40/2 R; 428/42; 428/43; 428/900; 428/99; 281/45

[58] Field of Search ..... 428/900, 40, 42, 43, 428/99; 281/45; 40/2 R, 10 R, 5

[56] References Cited

U.S. PATENT DOCUMENTS

| | | | |
|---|---|---|---|
| 856,689 | 6/1907 | Fehrenbach . | |
| 2,527,216 | 10/1950 | Harris | 281/45 |
| 3,350,045 | 10/1967 | Mayers | 428/900 X |
| 3,466,774 | 9/1969 | Borresen | 40/10 R |
| 3,945,559 | 3/1976 | Krautsack | 40/10 R |
| 4,405,973 | 9/1983 | Moscarillo | 428/40 X |

*Primary Examiner*—Alexander S. Thomas

*Attorney, Agent, or Firm*—Irving M. Weiner; Joseph P. Carrier; John J. Cantarella

[57] ABSTRACT

Each label on a sheet of labels is marked or markable with the name of a food item or category and/or the days of the week. The sheet is affixed to a backing member which has a magnetic strip to facilitate attachment to a substrate such as the wall of a refrigerator. Each label has a tab to facilitate removal from said sheet. A pencil is removably attached to backing member to facilitate marking the labels.

5 Claims, 4 Drawing Figures

FOOD LABEL DEVICE, KIT OF COMPONENTS THEREFOR, AND METHODS OF CONSTRUCTING AND UTILIZING SAME

BACKGROUND OF THE INVENTION

1. Field of the Invention

This invention relates to a food label device. More particularly, the invention is a kit or assemblage of components used for labeling food.

2. Description of Relevant Art

Labels have made life convenient. They provide easy identification and classification, both of which are important in our everyday lives. Some labeling devices that have been devised are described below:

U.S. Pat. No. 856,689 issued in 1907 to Fehrenbach entitled "LABEL PACKAGE" discloses a package containing labels which are in the form of a book. The book includes alternating pages of labels and lifting sheets, the lifting sheets having a greater width dimension than the label sheets so as to permit indexing and to provide hand holds for turning pages. Each label sheet contains a plurality of strips of labels, the strips being separated by perforated lines. Each strip is in turn provided with spaced perforated lines so as to define individual labels which may be pulled thereform for use, such as for marking shoe sizes, etc.

U.S. Pat. No. 1,649,442 issued in 1927 to Bredemeier entitled "MEANS AND METHOD OF LABELING CONTAINERS" discloses a labeling system employing conventional coffee cans. When purchased, the cans are provided with a small inner compartment having a strip of gummed labels provided therein. The labels are individually marked with the names of various foods and are adapted to be applied to the coffee can when empty, so it can serve as a labelled container for the particular food placed therein. The can is also provided with a specially marked space or panel for receiving the label.

U.S. Pat. No. 2,497,332 issued in 1950 entitled "MAGNETIC WRITING PAD" discloses a device comprising a writing surface defined by a flat metal plate. A single sheet of paper is securely held on the metal plate by means of four small magnets, and a supply of additional sheets is held at the upper end of the device by means of a quarter sphere portion provided with a magnet.

U.S. Pat. No. 4,159,129 issued in 1979 entitled "PHARMACEUTICAL RECORD AND LABEL SYSTEM" discloses a label system wherein pharmaceutical prescription labels are arranged on a backing sheet. The backing sheets with labels are separated into sections which are folded in an accordion-like fashion. When the label is typed, the typewritten material automatically transfers to the backing sheet. Thereafter, the label may be affixed to a medicine container, while the backing sheet provides a hard copy of the data for computerization. The labels are pre-marked with designated regions for a doctor's name, a patient's name, etc., as well as with a region for a service date. Each label is provided with an adhesive backing and is adapted to be pulled from the backing sheet; and a supplemental data area is provided alongside each label.

The invention disclosed herein provides features not provided for in the above discussed patents. These features include a sheet of labels, each label on the sheet being marked or markable with the name of a food product and a day of the week. Each label is removable from the sheet so that it can be placed on a food item of the same name for storage. Additionally, the date the food was stored may be marked on the label. A means for attaching the sheet of labels to a refrigerator or other convenient location is also provided.

SUMMARY OF THE INVENTION

The invention diclosed herein includes a backing member having a rear side and a front side. The backing member has a means for attaching the backing member to a substrate. The attaching means may be a magnetic strip or an adhesive material affixed to the rear side of the backing member. A magnetic strip is preferred, as it would facilitate the fixation of the backing member to a refrigerator. Such attachment is desirable as that would be a convenient place for storing food labels.

A sheet of labels is attached to the backing member. Each label on the sheet has the name of a food item thereon, or alternatively provides a space for placing the name of a food item thereon.

In addition, each label may have indicia thereon indicating the days of the week. The indicium indicating the day of the week a food item is labelled may be marked with an arrow, an "X", or other mark.

A sheet of labels can be attached to the front side of the backing member and each label on the sheet is separable from the other labels on the sheet.

On the side of the label opposite the indicia or markings is an adhesive. Preferably, this adhesive is pressure sensitive. More preferably, the sheet of labels will be releasably adhered to a release member and each removed label reapplicable to a wrapped food item.

BRIEF DESCRIPTION OF THE DRAWINGS

1.

2.

3.

4.

DETAILED DESCRIPTION OF PREFERRED EMBODIMENTS

Figure 1:
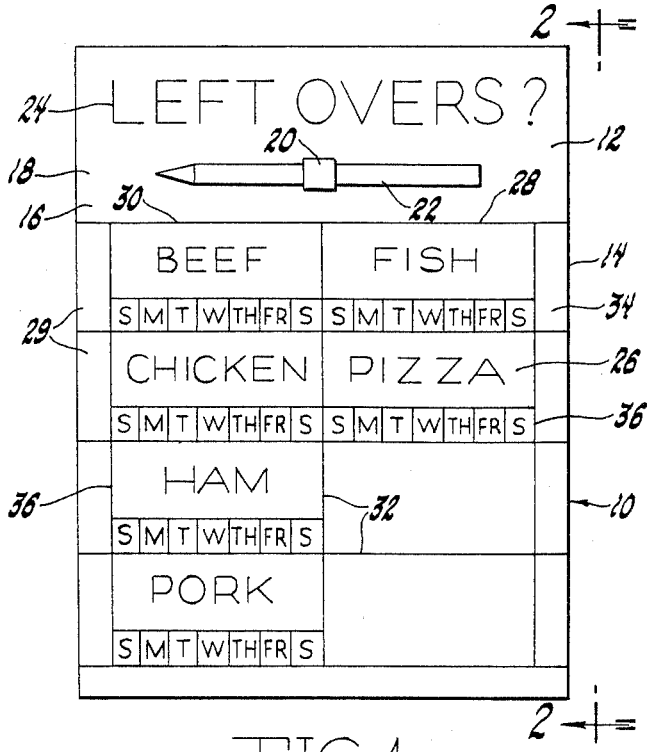
FIG. 1 is a front elevational view of an embodiment of the invention.

With reference to FIG. 1, there is depicted a food label device 10. Food label device 10 includes a backing member 12, a sheet or sheets 14 of labels 14 affixed to the backing members front side 16. Backing member 12 has a header 18; which may include pencil holder 20 which in turn may include pencil 22. In addition, header 18 may include a title 24 as depicted in FIG. 1. A title "LEFT OVERS?" may be suitable to note that the sheet of labels 14 may be used for labeling left over food.

As depicted in FIG. 1, sheet of labels 14 is essentially rectangular and is divided into a grid of rectangular labels 26. Each grid supports a right column of labels 28 and a left column of labels 30 which border each other. Each column includes a number of rows of labels 29. Each label 26 borders a corresponding label 16 which is, in an adjacent row or column. Borders 32 may be perforated, partially pre-cut, or otherwise weakened to facilitate moving a label 16 from sheet 14. Each label 16 includes a tab 34 at an outbound edge 36. Tab 34 facilitates removal of a label 16 from sheet 14.

Figure 4:
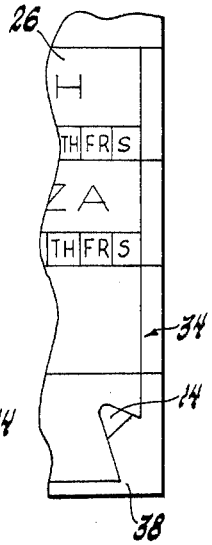
FIG. 4 is a fragmentary view of an embodiment of the invention.

As depicted in FIG. 4, sheet 14 may be removably affixed to a release member 38. Sheet 14 or, if there is a release member 38, release member 38 is affixed to backing member 12. Staples, velcro, glue, mounting posts or other fasteners may be used.

Figure 3:
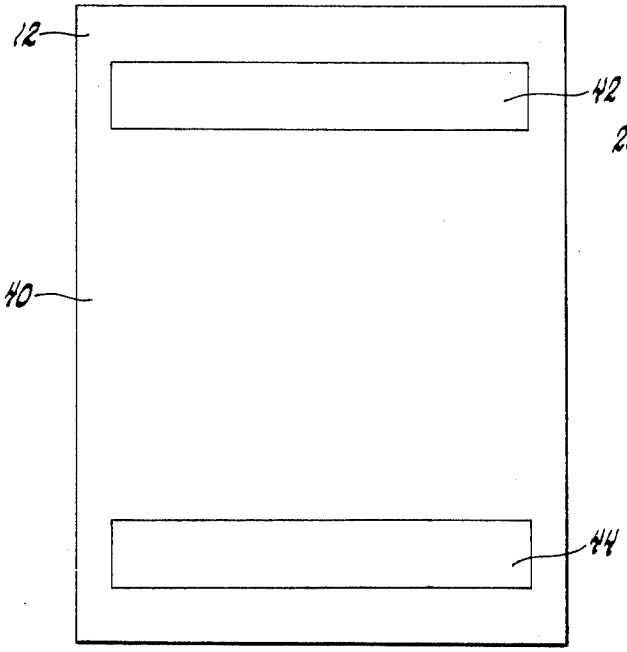
FIG. 3 is a rear elevational view of an embodiment of the invention.

As depicted in FIG. 3, backing member 12 may have a rear side 40 opposing front side 16. Affixed to rear side 40 is a fixing hook 42 such as a magnetic strip, adhesive strip, or other device for adhering backing member 12 to a substrate such as wall, refrigerator, or the like. Hook 42 preferably is positioned at an upper portion of backing member 12 opposing title 24. A second hook 44 may also be attached to rear side 40. Preferably, second hook 44 would be attached at a different position on backing member 12 than hook 42.

Figure 2:
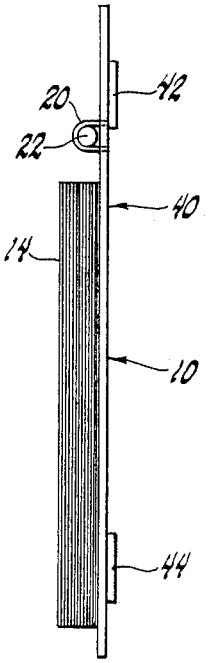
FIG. 2 is a side elevational view of an embodiment of the invention taken along line 2—2 of FIG. 1.

As depicted in FIG. 2, backing member 12 may support a plurality of sheets 14. Pencil holder 20 may be constructed from a closed U-shape loop of material emanating from front side 16 of backing member 12.

As depicted in FIG. 1, each label 16 may be either left blank or may contain information thereon. The information may include the name of the food item which the label is to be placed on. Exemplary names are BEEF; CHICKEN; HAM; PORK; FISH; PIZZA or other food names.

In addition to the names of the food items to which the labels are to be affixed, the labels may include indicia designating the days of the week. Suitable indicia would be as follows: S; M; T; W; TH; FR; S.

Each label 16 may have an adhesive back for adhering said label 16 to a package. In the embodiments to which the sheet of labels 14 are attached to a release member 38; said adhesive should be of such a nature that each label on the sheet may be removed therefrom and subsequently adhered to a food package. Pressure sensitive labels are suitable for this purpose.

In operation, the device 10 would be affixed to a refrigerator or other substrate using hook 42 and or second hook 42. The appropriate label 26 would be selected. Pencil 22 would be removed from pencil holder 20 and used to mark the appropriate indicia for the day of the week on which the food is to be stored. The label 16 would then be removed from sheet 14 and affixed to the package containing the food item to be stored.

Device 10 may be sold as a kit. The kit may include in combination, backing member 12 having hook 42 affixed to backing members rear side 40, pencil holder 20 affixed to the backing members front side 16, and sheet or sheets of labels 14 to be affixed to the front side of said backing member 16.

Although there had be described what are here considered to be the preferred embodiments of the invention, it will be understood that the invention may be embodied in other specific forms without departing from the spirit or essential characteristics thereof. The present embodiments are, therefore to be considered in all respects to be illustrative and not restrictive.

I claim:

1. A food label device, comprising in combination:

a stiff backing member having a front side and an opposing rear side;

a magnetic strip attached to said rear side of said backing member for affixing said backing member to a magnetized substrate;

a plurality of sheets each containing a plurality of individually removable, pressure-sensitive, adhesive labels;

said plurality of sheets being affixed to said front side of said backing member;

means for removably securing a writing instrument to said front side of said backing member;

said securing means being constructed from a closed U-shaped loop of material emanating from the front side of said backing member;

each of said labels is marked with the name of a food item; and each of said plurality of labels includes a tab that can be gripped and pulled for removing said label from said sheet, and the plurality of labels on any sheet are separated from each other by perforated borders so that they may be individually, randomly removed.

2. The device of claim 1, wherein each of said labels is marked with indicia; and each of said indicia represents a day of the week.

3. The device of claim 2, wherein said plurality of labels are lightly adhered to a release member; and said release member is attached to said front side of said backing member.

4. A kit of components for a food label device, comprising in combination:

a stiff backing member having a front side and an opposing rear side;

said backing member having a magnetic strip attached to said rear side;

a plurality of sheets each containing a plurality of individually removable pressure-sensitive, adhesive labels;

said labels being marked with the name of a food item and with indicia representing the days of the week;

means for affixing said plurality of sheets to the front side of said backing member with said labels facing away from said backing member;

a writing instrument for writing on said labels, and a means for releasably securing said writing instrument to said backing member;

each of said plurality of labels includes a tab that can be gripped and pulled for removing said label from said sheet, and the plurality of labels on any sheet are separated from each other by perforated borders so that they may be individually, randomly removed.

5. The method of constructing a food label device, comprising the steps of:

securing a stiff backing member having a front side and an opposing rear side;

attaching a means for attaching said backing member to a substrate on said rear side of said backing member;

affixing a plurality of sheets each containing a plurality of individually removable, pressure-sensitive and adhesive labels to said front side of said backing member;

affixing a U-shaped loop of material for releasably securing a writing instrument to said front side of said backing member;

marking each of said plurality of labels with indicia; and forming a tab which can be gripped and pulled on each of said plurality of labels, and forming perforated borders between the plurality of labels on any sheet so that they may be easily, individually, randomly removed.

* * * * *